US011590636B2

(12) United States Patent
Richards

(10) Patent No.: US 11,590,636 B2
(45) Date of Patent: Feb. 28, 2023

(54) DRIVER EXTENSION WITH HAND KNOBS

(71) Applicant: Eric Richards, Valley, AL (US)

(72) Inventor: Eric Richards, Valley, AL (US)

( * ) Notice: Subject to any disclaimer, the term of this patent is extended or adjusted under 35 U.S.C. 154(b) by 338 days.

(21) Appl. No.: 17/065,112

(22) Filed: Oct. 7, 2020

(65) Prior Publication Data

US 2021/0101265 A1 Apr. 8, 2021

Related U.S. Application Data

(60) Provisional application No. 62/912,220, filed on Oct. 8, 2019.

(51) Int. Cl.

| | |
|---|---|
| ***B25B 23/16*** | (2006.01) |
| ***B25B 13/06*** | (2006.01) |
| ***B25B 15/02*** | (2006.01) |
| ***B25B 13/50*** | (2006.01) |

(52) U.S. Cl.

CPC ..... *B25B 23/16* (2013.01); *B25B 13/06* (2013.01); *B25B 15/02* (2013.01); *B25B 13/5091* (2013.01)

(58) Field of Classification Search

CPC ..... B25B 23/16; B25B 23/0021; B25B 13/06; B25B 13/481; B25B 13/5091; B25B 15/02

See application file for complete search history.

(56) References Cited

U.S. PATENT DOCUMENTS

| | | | | |
|---|---|---|---|---|
| 3,738,768 | A * | 6/1973 | Kuhn | B25B 13/44 279/42 |
| 4,060,113 | A * | 11/1977 | Matsushima | B25B 23/106 81/448 |
| 4,254,674 | A | 3/1981 | Strussion et al. | |
| 4,357,845 | A | 11/1982 | Cornia | |
| 5,048,378 | A | 9/1991 | Nikolas | |
| 6,427,564 | B1 * | 8/2002 | Nelson | B25G 1/105 81/177.1 |
| 6,715,384 | B1 | 4/2004 | Kozak | |
| 7,143,670 | B2 * | 12/2006 | Geary | B25B 13/481 81/177.2 |
| 7,340,984 | B2 * | 3/2008 | Hsieh | B25B 13/06 81/177.85 |
| 7,430,944 | B1 | 10/2008 | Miller | |
| 8,205,529 | B1 | 6/2012 | Laurie | |
| 10,124,471 | B2 * | 11/2018 | Stumer | B25B 13/5091 |

FOREIGN PATENT DOCUMENTS

| | | | | |
|---|---|---|---|---|
| GB | 2275637 A * | 9/1994 | | B25B 13/06 |

* cited by examiner

*Primary Examiner* — David B. Thomas

(74) *Attorney, Agent, or Firm* — Boudwin Intellectual Property; Daniel Boudwin

(57) ABSTRACT

A driver extension with hand knobs is shown and described. The driver extension with hand knobs includes an elongated rod. The elongated rod has a first end opposite a second end. The first end of the elongated rod is a tool attachment end. The second end of the elongated rod is a securement end for a socket or a screwdriver. A pair of opposing hand knobs are secured along the elongated rod extending away from the elongated rod. The knobs are positioned in the same plane.

20 Claims, 4 Drawing Sheets

DRIVER EXTENSION WITH HAND KNOBS

CROSS REFERENCE TO RELATED APPLICATIONS

This application claims the benefit of U.S. Provisional Application No. 62/912,220 filed on Oct. 8, 2019. The above identified patent application is herein incorporated by reference in its entirety to provide continuity of disclosure.

BACKGROUND OF THE INVENTION

The present invention relates to driver extensions with hand knobs. More particularly, the present invention provides a socket extension or screwdriver extension with hand knobs location thereon.

There are several different common types of tools that are used to tighten and secure fasteners. One of these tools is a socket wrench. Typically, socket wrenches have different sized attachments that are used in order to tighten the fastener. Often an extender is used to move the attachment away from the tool making it easier to use. In some instances, however, the socket wrench is still difficult to position in a small space. In this instance it can be difficult to secure the fastener solely by grasping the extender without the wrench.

Another tool that is used to secure items together via a fastener is a power drill and a screwdriver extension. Often an individual that has a power drill and interchangeable screwdriver heads does not also carry a screwdriver. This means that in areas where the drill does not easily fit it can be difficult to use a screw to fasten items together. An extension of this nature is often narrow with no gripping section as this is not the intended use.

Consequently, there is a need for an improvement in the art of hand tools. The present invention substantially diverges in design elements from the known art while at the same time solves a problem many people face when fastening items in small spaces using varying tools. In this regard the present invention substantially fulfills these needs.

SUMMARY OF THE INVENTION

The present invention provides a driver extension with a hand knob wherein the same can be utilized for providing convenience for the user when using a driver extension without attaching it to a tool. The driver extension with hand knobs is comprised of an elongated rod. The elongated rod has a first end opposite a second end. The first end of the elongated rod is a tool attachment end. The second end of the elongated rod is a securement end for a socket or a screwdriver. A pair of apposing hand knobs are secured along the elongated rod extending away from the elongated rod. The knobs are positioned in the same plane.

Another object of the driver extension with hand knobs is to have the pair of knobs position along the elongated rod in a position that is closer to the first end than the second end.

Another object of the driver extension with hand knobs is to have the hand knobs extend away from the elongation rod in a perpendicular manner.

Another object of the driver extension with hand knobs is to have the hand knobs extend away from the elongation rod having an angle toward the first end.

Another object of the driver extension with hand knobs is to have the hand knobs extend away from the elongation rod having an angle toward the second end.

Another object of the driver extension with hand knobs is to have an elongated rod which has a circular cross-section.

Another object of the driver extension with hand knobs is to have an elongated rod which has a hexagonal cross-section.

Another object of the driver extension with hand knobs is to have the second end be a square end for securing to a socket.

Another object of the driver extension with hand knobs is to have the second end configured to secure to a screwdriver attachment.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1:
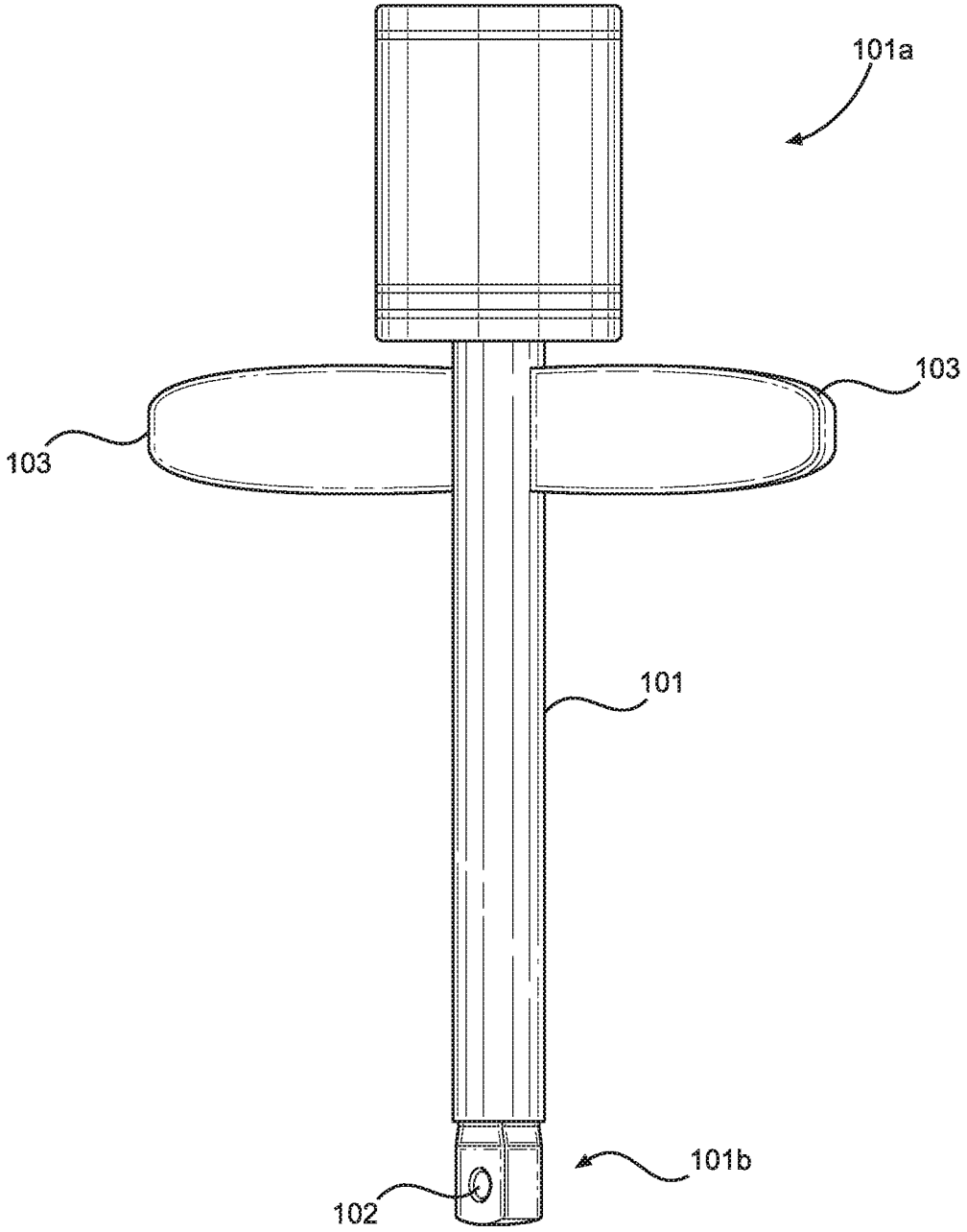
FIG. 1 shows a perspective view of an embodiment of the driver extension with hand knobs.

With regard to the reference numerals used, the following numbering is used throughout the drawings.

101 Elongated rod
101*a* First end of the elongated rod
101*b* Second end of the elongated rod
102 Ball de taunt
103 Hand knobs
201 Screwdriver attachment
301 Socket
302 Socket wrench connection
303 Knurled surface
401 Socket wrench
501 Crescent wrench

DETAILED DESCRIPTION OF THE INVENTION

Reference is made herein to the attached drawings. Like reference numerals are used throughout the drawings to depict like or similar elements of the driver extension with hand knobs. For the purposes of presenting a brief and clear description of the present invention, a preferred embodiment will be discussed as used for the driver extension with hand knobs. The figures are intended for representative purposes only and should not be considered to be limiting in any respect.

Referring now to FIG. 1, there is shown a perspective view of an embodiment of the driver extension with hand knobs. The driver extension includes an elongated rod 101. In the shown embodiment, the elongated rod 101 is a cylindrical shape. The elongated rod 101 has a first end 101*a* opposite a second end 101*b*. The first end 101*a* of the elongated rod 101 is a tool securement end. A tool, such as a socket wrench, for example, will be attached to this end of the elongated rod 101. In the shown embodiment, the elongated rod 101 has a larger first end 101*a* such that a socket wrench may secure to this end.

In the shown embodiment, the second end 101*b* of the elongated rod 101 is a securement end. The second end 101*b* will connect to, for example a socket. In one embodiment, the second end has a square cross section. This will allow the second end 101*b* to connect to a majority of different sockets. In one embodiment, the second end 101*b* includes a ball detent 102. This will safely secure a socket to the second end 101*b*. The ball detent 102 will further ensure that the socket is easily removed from the second end 101*b* when the task is completed.

The driver extension with hand knobs includes at least a pair of hand knobs 103 extending from the elongated rod 101. In one embodiment, the hand knobs 103 extend away from the elongated rod 101 in a perpendicular manner. In one embodiment, the pair of hand knobs 103 extend away from the elongated rod 101 in opposite directions. In other words, the pair of hand knobs 103 are disposed along the same plane.

In one embodiment, the pair of hand knobs 103 are secured to the elongated rod via welds. This will allow for the hand knobs 103 to be added to any driver extension. In another embodiment, the hand knobs 103 are molded into the elongated rod. This will allow for a one-piece construction of the driver extension.

Figure 2:
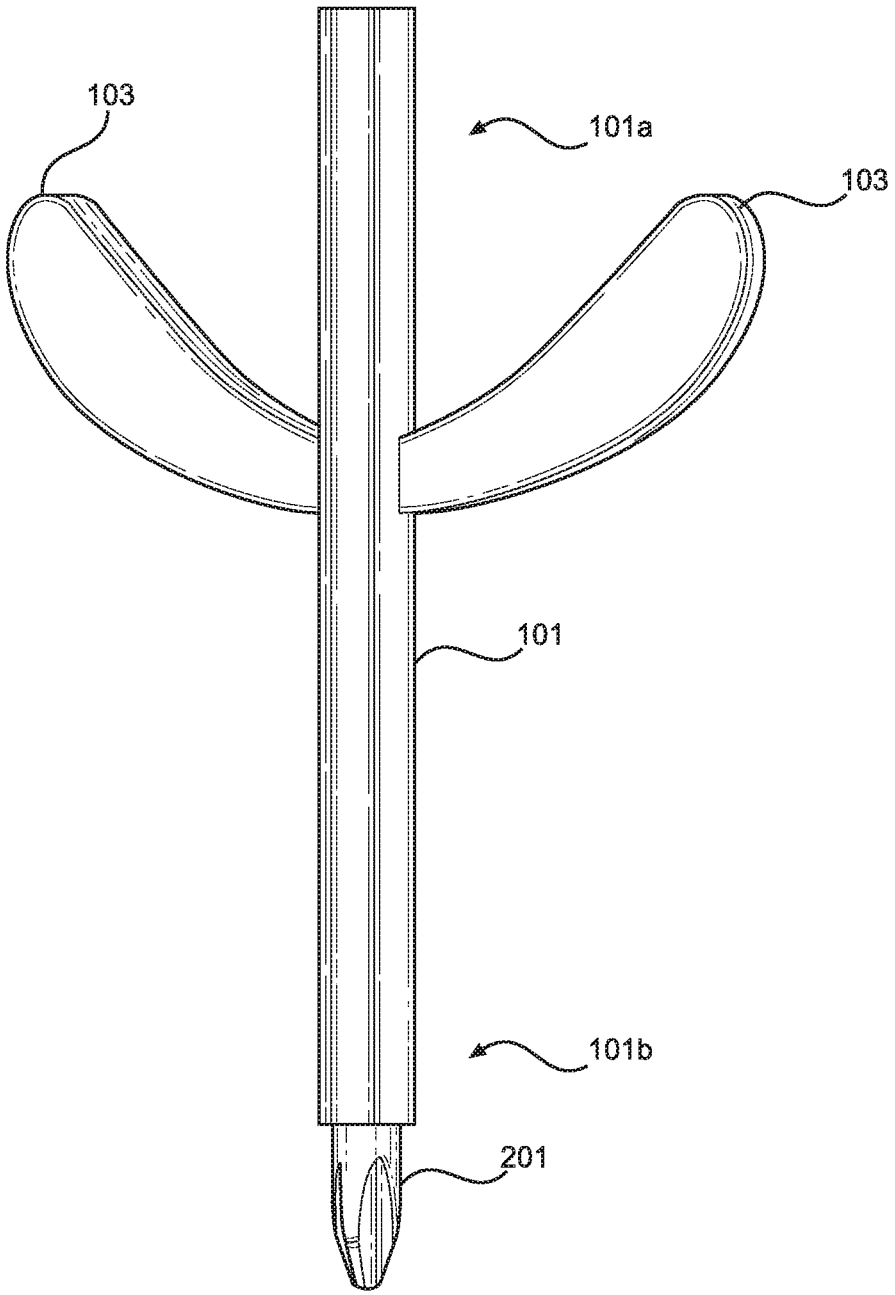
FIG. 2 shows a perspective view of an alternative embodiment of the driver extension with hand knobs.

Referring now to FIG. 2, there is shown a perspective view of an alternative embodiment of the driver extension with hand knobs. In the shown embodiment, the driver extension is meant to connect to a different tool. In this embodiment, the driver extension has a hexagonal elongated rod 101. This will better allow the extension to secure to a drill, for example. It is contemplated that any rotational tool may be used. In this embodiment, the first end 101*a* of the elongated rod 101 is configured to secure to a rotational tool as mentioned above. In the shown embodiment, the first end 101*a* is smooth. However, in other embodiments there may be an indentation around the elongated rod 101 in a position near the first end 101*a*. This indentation will allow the driver extension to be secured in a quick connect drill chuck.

In this embodiment the second end 101*b* of the elongated rod 101 is configured to secure to a screwdriver attachment 201. In the shown embodiment, the screwdriver attachment 201 fits within the second end 101*b* of the elongated rod 101. In another embodiment, the elongated rod 101 has a connector located at the second end 101*b*. In one embodiment, the connector will fit over the second end 101*b*. The connector will then allow for the screwdriver attachment 201 to be secured to the driver extension by being placed within the connector.

In one embodiment the connector is cylindrical shaped. The connector has a pair of channels one located at each end. One of the channels will secured to the elongated rod 101. The other channel will removably secure a screwdriver attachment 201.

The pair of hand knobs 103 are secured to the elongated rod 101 near the first end 101*a*. The pair of hand knobs 103 extend away from the elongated rod 101. The pair of hand knobs 103 are located within the same plane. In this embodiment, the pair of hand knobs 103 extend away from the elongated rod 101 in an angled manner. In the shown embodiment, the angle is acute, such that the hand knobs 103 are pointed toward the first end 101*a*. This will allow for the hand knobs 103 to potentially be narrower than if they extended away at a perpendicular manner, while still providing adequate gripping surface. Further, the shown embodiment the hand knobs 103 are curved. This will better ensure that there are no sharp edges.

Figure 3:
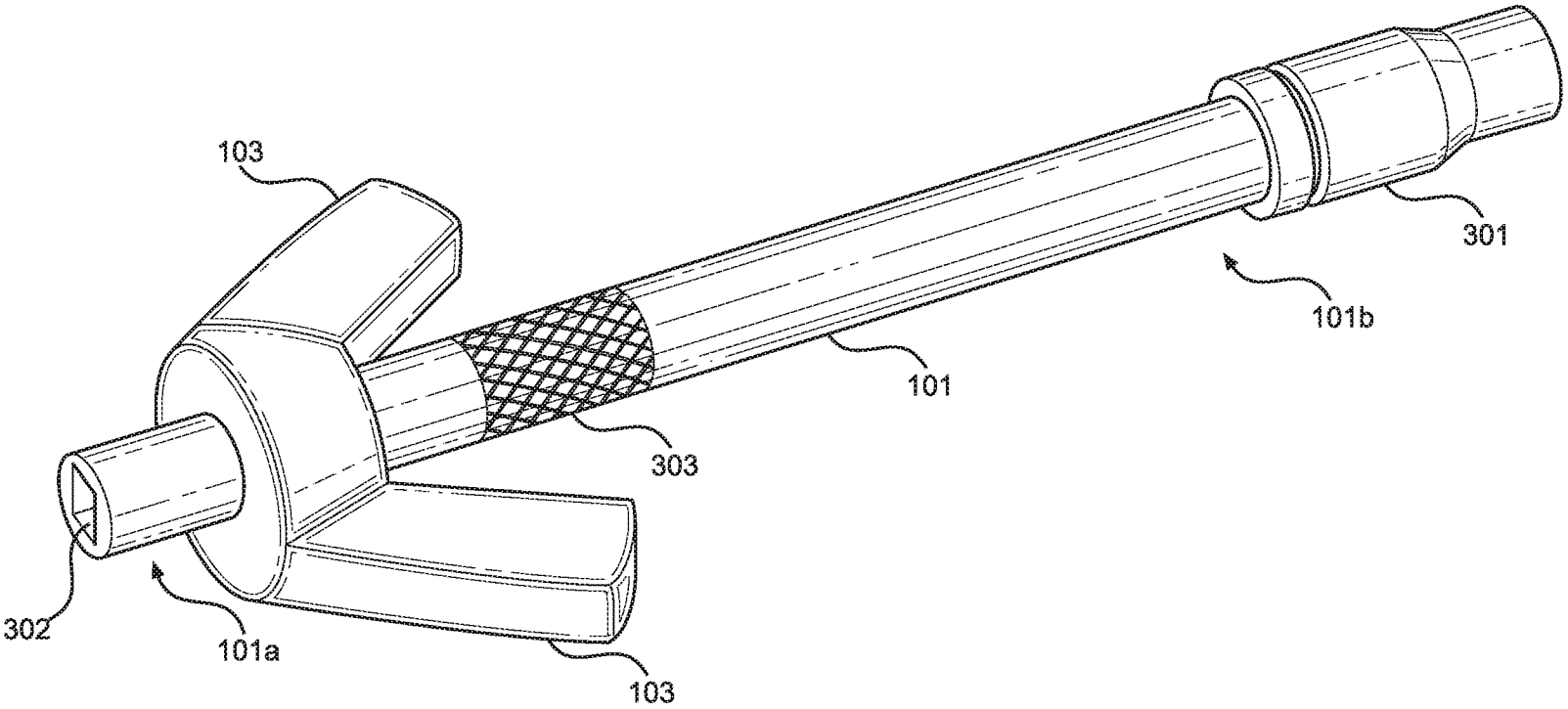
FIG. 3 shows a perspective view of an embodiment of a socket wrench extension with hand knobs.

Referring now to FIG. 3, there is shown a perspective view of an embodiment of a socket wrench extension with hand knobs. In this embodiment, the pair of hand knobs 103 are secured to the elongated rod 101 near the first end 101*a*. The pair of hand knobs 103 extend away from the elongated rod 101. The pair of hand knobs 103 are located within the same plane. In this embodiment, the pair of hand knobs 103 extend away from the elongated rod 101 in an angled manner. In the shown embodiment, the acute angle is pointed toward the second end 101*b*. This will allow for the hand knobs 103 to potentially be narrower than if they extended away at a perpendicular manner, while still providing adequate gripping surface.

Further, in the shown embodiment the elongated rod 101 is shown connected to a socket 301 at the second end 101*b*. Further, the first end 101*a* is shown to have a square indentation 302 for a socket wrench to secure thereto. In the shown embodiment the elongated rod 101 has a knurled surface 303. The knurled surface 303 is located proximate to the had knob 103. This ill ensure that the knurled surface 303 and the hand knob 103 may be grasped at the same time. This will provide extra gripping surface when used by hand.

Figure 4:
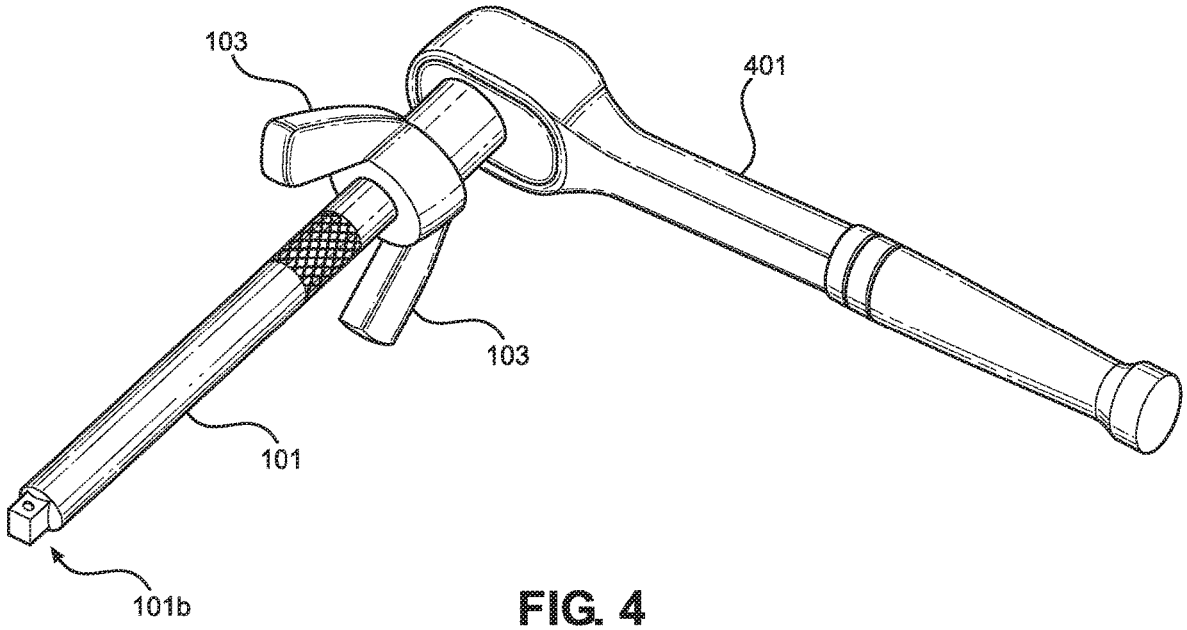
FIG. 4 shows a perspective view of an embodiment of the driver extension with hand knobs attached to a socket wrench

Referring now to FIG. 4, there is shown a perspective view of an embodiment of the driver extension with hand knobs attached to a socket wrench. In this embodiment, the driver extension with hand knobs is secured to a socket wrench 401. In this embodiment, the pair of hand knobs 103 are angled toward the second end 101*b* of the elongated rod 101. This will allow for the pair of hand knobs 103 to stay out of the way of the socket wrench 401. This means that the pair of hand knobs 103 will not contact the socket wrench 401 even if the socket wrench 401 is rotated a full three hundred sixty degrees.

Figure 5:
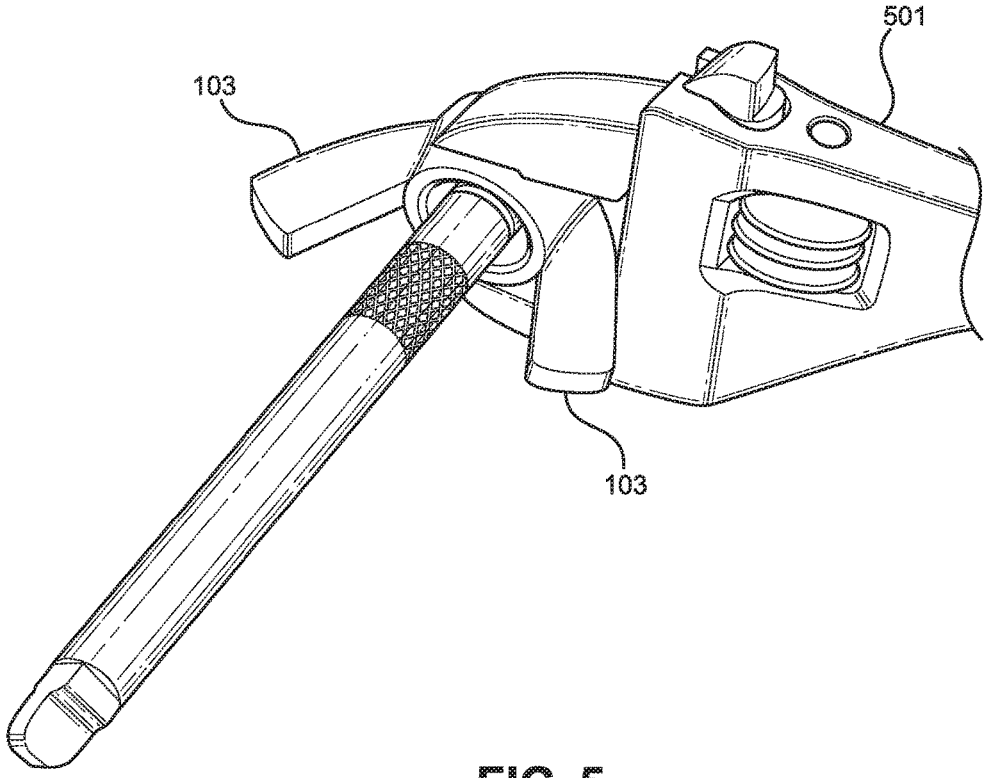
FIG. 5 shows perspective view of an embodiment of the driver extension with hand knobs being secured to a crescent wrench.

Referring now to FIG. 5, there is shown perspective view of an embodiment of the driver extension with hand knobs being secured to a crescent wrench 501. In this embodiment, the driver extension is used by applying toque with a crescent wrench 501. In this embodiment, the crescent wrench 501 engages the pair of hand knobs 103. Buy engaging the hand knobs 103 the crescent wrench 501 will have leverage to turn the driver extension. Without the hand knobs 103 the crescent wrench 501 will not properly grasp the driver extension and simply turn around the extension does not turn the driver. Further, this will allow the extension to have additional torque added. This can potentially allow the driver extension to be placed in a tight space then still operated as needed.

It is therefore submitted that the instant invention has been shown and described in what is considered to be the most practical and preferred embodiments. It is recognized, however that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A driver extension with hand knobs, the extension comprises:

an elongated rod having a first end opposite a second end;

wherein the first end is a tool attachment end;

wherein the second end is a securement end;

a pair of opposing hand knobs are secured along the elongated rod extending away from the elongated rod;

wherein the hand knobs extend away from the elongated rod at an acute angle toward the first end;

wherein the knobs are positioned in the same plane.

2. The driver extension with hand knobs of claim 1, wherein the pair of knobs are positioned along the elongated rod closer to the first end than the second end.

3. The driver extension with hand knobs of claim 1, wherein the hand knobs extend away from the elongated rod in a perpendicular manner.

4. The driver extension with hand knobs of claim 1, wherein the elongated rod has a circular cross-section.

5. The driver extension with hand knobs of claim 1, wherein the elongated rod has a hexagonal cross-section.

6. The driver extension with hand knobs of claim 1, wherein the second end is a square end for securing to a socket.

7. The driver extension with hand knobs of claim 1, wherein the second end is configured to secure a screwdriver attachment.

8. A driver extension with hand knobs, the extension comprises:

an elongated rod having a first end opposite a second end;

wherein the first end is a tool attachment end;

wherein the second end is a securement end;

a pair of opposing hand knobs are secured along the elongated rod extending away from the elongated rod;

wherein the hand knobs extend away from the elongated rod at an angle toward the second end;

wherein the knobs are positioned in the same plane.

9. The driver extension with hand knobs of claim 8, wherein the pair of knobs are positioned along the elongated rod closer to the first end than the second end.

10. The driver extension with hand knobs of claim 8, wherein the hand knobs extend away from the elongated rod in a perpendicular manner.

11. The driver extension with hand knobs of claim 8, wherein the elongated rod has a circular cross-section.

12. The driver extension with hand knobs of claim 8, wherein the elongated rod has a hexagonal cross-section.

13. The driver extension with hand knobs of claim 8, wherein the second end is a square end for securing to a socket.

14. The driver extension with hand knobs of claim 8, wherein the second end is configured to secure a screwdriver attachment.

15. A driver extension with hand knobs, the extension comprises:

an elongated rod having a first end opposite a second end;

wherein the first end is a tool attachment end;

wherein the second end is a securement end;

wherein the elongated rod has a hexagonal cross-section;

a pair of opposing hand knobs are secured along the elongated rod extending away from the elongated rod;

wherein the knobs are positioned in the same plane.

16. The driver extension with hand knobs of claim 15, wherein the pair of knobs are positioned along the elongated rod closer to the first end than the second end.

17. The driver extension with hand knobs of claim 15, wherein the hand knobs extend away from the elongated rod at an acute angle toward the first end.

18. The driver extension with hand knobs of claim 15, wherein the hand knobs extend away from the elongated rod at an angle toward the second end.

19. The driver extension with hand knobs of claim 15, wherein the second end is a square end for securing to a socket.

20. The driver extension with hand knobs of claim 15, wherein the second end is configured to secure a screwdriver attachment.

* * * * *